US008644736B2

(12) United States Patent
Kakubari

(10) Patent No.: US 8,644,736 B2
(45) Date of Patent: Feb. 4, 2014

(54) DEVELOPING APPARATUS

(75) Inventor: Kouichi Kakubari, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 401 days.

(21) Appl. No.: 12/754,014

(22) Filed: Apr. 5, 2010

(65) Prior Publication Data

US 2010/0260507 A1 Oct. 14, 2010

(30) Foreign Application Priority Data

Apr. 8, 2009 (JP) ..... 2009-094102

(51) Int. Cl.
*G03G 15/00* (2006.01)

(52) U.S. Cl.
USPC ..... 399/254; 399/30; 399/62; 399/102

(58) Field of Classification Search
USPC ..... 399/24, 27, 29, 61–63, 119, 120, 252, 399/254, 258–260
See application file for complete search history.

(56) References Cited

U.S. PATENT DOCUMENTS

| | | | | |
|---|---|---|---|---|
| 2002/0159781 | A1* | 10/2002 | Hatori | 399/30 |
| 2004/0114966 | A1* | 6/2004 | Masuda | 399/260 |
| 2007/0231015 | A1* | 10/2007 | Sakamaki | 399/257 |
| 2008/0181672 | A1* | 7/2008 | Hatakeyama et al. | 399/254 |
| 2008/0230430 | A1* | 9/2008 | Chou et al. | 206/527 |
| 2008/0253809 | A1 | 10/2008 | Aimoto | |
| 2010/0196057 | A1* | 8/2010 | Mihara et al. | 399/254 |

FOREIGN PATENT DOCUMENTS

| | | | |
|---|---|---|---|
| JP | 04-125661 | A | 4/1992 |
| JP | 2002-139901 | A | 5/2002 |
| JP | 3434118 | | 8/2003 |
| JP | 2003-295589 | | 10/2003 |
| JP | 2005-202242 | | 7/2005 |
| JP | 2007-72347 | | 3/2007 |
| JP | 2008-262091 | | 10/2008 |

* cited by examiner

*Primary Examiner* — Walter L Lindsay, Jr.
*Assistant Examiner* — Jessica L Eley
(74) *Attorney, Agent, or Firm* — Canon USA Inc IP Division

(57) ABSTRACT

In the present invention, for a developing apparatus provided with a sensor for detecting the toner density of a developer, retention of the developer near the sensor face can be suppressed by increasing the force with which the developer present near the sensor face is carried in a shaft direction of a stirring/carrying member.

25 Claims, 8 Drawing Sheets

DEVELOPING APPARATUS

BACKGROUND OF THE INVENTION

1. Field of the Invention

The present invention relates to a developing apparatus which uses a two-component developer to develop an electrostatic latent image formed on an image carrier in an image forming apparatus, such as a copying machine, a printer, a recorded image display device, and a facsimile machine, using an electrophotographic method, an electrostatic recording method or the like.

2. Description of the Related Art

For a developing apparatus included in an image forming apparatus, a one-component developer having a non-magnetic toner or a magnetic toner as a main component, or a two-component developer having a non-magnetic toner and a magnetic carrier as main components, is used. Especially for a color image forming apparatus which forms a full color or a multi-color image by electrophotography, from the perspective of the tint and the like of the image, most developing apparatuses use a two-component developer.

Consequently, to stabilize an output image, it is very important to maintain the mixing ratio (hereinafter, "toner density") of the non-magnetic toner and the carrier in the developing apparatus. Therefore, various methods have in the past been proposed as a method for replenishing the developer in the developing apparatus.

The following methods for controlling a toner replenishment amount are known. In one such example, a detection unit is provided near a photosensitive drum, a toner image (patch image) developed on the photosensitive drum is irradiated with light, and the transmitted light or reflected light there is detected by the detection unit. Then, based on the detection result, the toner replenishment amount is controlled.

In another example, the detection unit is provided near a developer carrier, and the toner density is detected based on the reflected light when the developer carried on the developer carrier is irradiated with light. Further, in another example, the toner density is detected by detecting changes in the apparent magnetic permeability of the developer in a fixed volume near a sensor utilizing the inductance of a coil. Still further, in another example, the amount of toner which will be consumed by an image is predicted based on a video count number of the density of an image obtained by reading an image information signal by a charge-coupled device (CCD) sensor or the like, and the toner amount corresponding to the predicted amount is replenished.

Among these examples, the method in which the density is controlled by a magnetic permeability sensor is used because the toner in the developing unit can be detected by a simple method without causing any downtime.

Generally, the output value of a magnetic permeability sensor which utilizes coil inductance decreases when the toner density increases, since the amount of carrier included in a fixed volume of developer decreases, causing the apparent magnetic permeability to decrease. Conversely, the output value of the sensor increases when the toner density decreases, since the amount of carrier included in a fixed volume increases, causing the apparent magnetic permeability to increase. To stably maintain the toner density in a developing apparatus having a magnetic permeability sensor, an appropriate amount of toner may be replenished by accurately detecting the toner density in the developing apparatus, and basing the replenishment amount on that detection result.

However, there are the following problems when controlling the toner density using a magnetic permeability sensor. As the arrangement location for the toner density sensor, it is desirable that the toner density sensor is in contact with the developer, the developer has a thickness and a surface which allows the toner density to be detected, and the flow of the developer near the toner density sensor face is uniform. However, the user has demanded in recent years that image forming apparatuses have a reduced size, and as a result, a size of the developing apparatus has been reduced. As a consequence, the arrangement location of the toner density sensor can be limited.

Normally, the developer is more easily retained due to the effects of gravity when the developer is closer to the bottom of the developing apparatus. Further, the developer which has entered a clearance that exists between the density sensor and the development container tends to be retained because there is no direct carrying unit. Therefore, compared with toner which is directly carried by a carrying member of a carrying screw, the toner at the clearance is not carried out as easily, and tends to be retained. A toner that is susceptible to retention like this may show a different density from the actual toner density because the toner cannot be easily replaced. Thus, there is the problem that the toner density cannot be detected with high accuracy.

Accordingly, Japanese Patent No. 3434118 discusses promoting stirring (developer replacement) of the developer by providing a rib on a shaft portion of a stirring/carrying member which opposes a magnetic permeability sensor face.

However, with a configuration such as that in Japanese Patent No. 3434118, there is the following problem. More specifically, the direction that the developer can be moved can be divided into two components, that is, a shaft direction of the developer stirring/carrying screw, and a circumferential direction of the developer stirring/carrying screw. When a rib is provided on the shaft of the stirring/carrying member as in Japanese Patent No. 3434118, the developer is carried in the circumferential direction of the stirring/carrying screw. In other words, the carrying direction of the developer in a stirring chamber 24 will be perpendicular to the circumferential direction. Therefore, the carrying rate in the screw rotational shaft direction of the developer at the portion facing the sensor face decreases.

In Japanese Patent No. 3434118, although the rib provided on the shaft of the stirring/carrying member promotes developer replacement, it also reduces the carrying rate of the developer (carrying speed of the developer) in the shaft direction at the portion facing the sensor face. The fact that the carrying rate of the developer decreases means that the developer which is present in the portion opposing the sensor face tends to stop at the same location, so that developer replacement in the portion opposing the sensor face becomes more difficult. Consequently, it becomes impossible to accurately follow the changes in the developer density in the developing apparatus. Further, if the developer is retained in the portion opposing the sensor, a surface of the developer opposing the sensor tends to be unstable. Therefore, if the surface of the developer fluctuates, height density at a detecting position of the sensor fluctuates, which may cause false detection. Thus, although providing a rib on the shaft of the developer stirring/carrying member has an effect in improving stirring properties, it has not been sufficient in terms of its effect on developer replacement.

On the other hand, while the carrying rate in the shaft direction could be increased for all areas, as a result, this would deteriorate the stirring properties of the developer in the developing apparatus. Thus, a problem would arise in terms of stirring (i.e., it becomes more difficult for the replenishment toner to mix with the developer, so that the toner density in the developing apparatus would not be uniform).

SUMMARY OF THE INVENTION

The present invention is directed to providing a developing apparatus capable of suppressing deterioration in density detection accuracy due to developer retention at a sensor position in a developing apparatus which replenishes toner using a density sensor to detect the magnetic permeability of the developer in a development container. Further, the present invention is directed to suppressing deterioration in density detection accuracy due to developer retention at a sensor position while suppressing deterioration of the stirring properties.

According to an aspect of the present invention, a developing apparatus includes a developer container containing a developer which comprises a non-magnetic toner and a magnetic carrier, a circulation path configured to circulate the developer in the developer container, a carrying unit which is provided in the circulation path and which has a rotatable carrying screw configured to carry the developer in the developer container, and a density sensor which is configured to face a driving device driving the carrying unit and to face the carrying unit, and configured to detect information relating to magnetic permeability of the developer in the circulation path, wherein a carrying ability per unit drive time of the carrying unit in a direction of a rotational axis of the carrying screw is greater in a first area, which is a vicinity on an upstream side in a developer carrying direction from a portion facing the density sensor, than in a second area, which is on an upstream side in the developer carrying direction from the first area.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Before describing the developing apparatus according to the present invention, first, the outline of a representative electrophotographic image forming apparatus illustrated in FIG. 1 will be described as an example of the image forming apparatus on which the developing apparatus is mounted.

Figure 1:
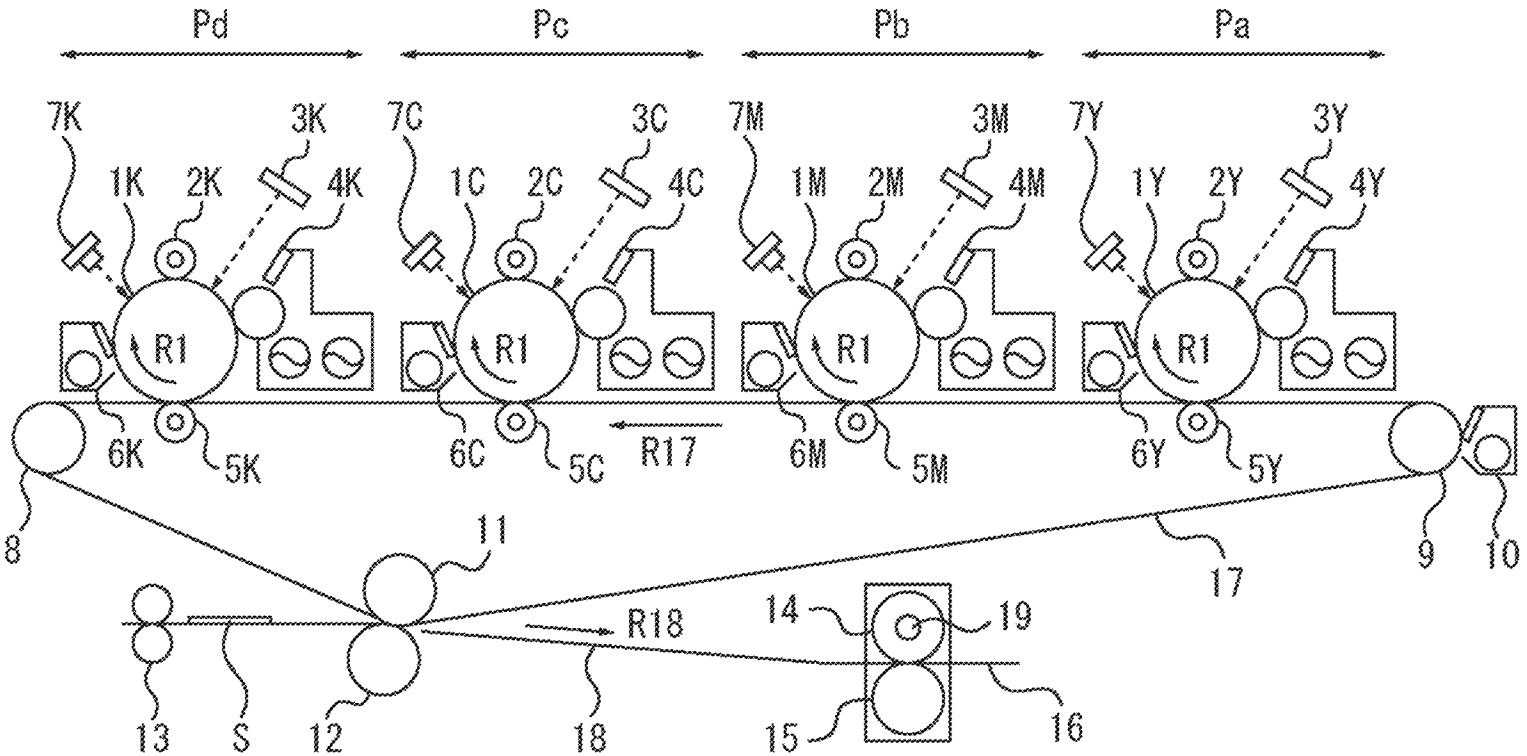
FIG. 1 is a longitudinal sectional view schematically illustrating a general configuration of an image forming apparatus according to the present invention.

The image forming apparatus illustrated in FIG. 1 is a full color electrophotographic image forming apparatus for four colors having four image forming units. FIG. 1 is a longitudinal sectional view schematically illustrating the general configuration of such an image forming apparatus. The image forming apparatus illustrated in FIG. 1 has four image forming units (image forming stations) Pa, Pb, Pc, and Pd arranged from an upstream side to a downstream side along a rotation direction (arrow R17 direction) of an intermediate transfer belt 17 acting as an intermediate transfer member. The image forming units Pa, Pb, Pc, and Pd form, in that order, toner images in yellow, magenta, cyan, and black, respectively. The respective Pa, Pb, Pc, and Pd image forming units include a drum-shaped electrophotographic photosensitive member (hereinafter, "photosensitive drum") 1Y, 1M, 1C, and 1B as an image carrier. In the below description, unless it is specifically necessary to distinguish the colors, the photosensitive drums 1Y, 1M, 1C, and 1B are simply denoted as "photosensitive drum 1".

Each photosensitive drum 1 is rotationally driven in the direction of arrow R1 (in FIG. 1, anticlockwise direction). On the periphery of each photosensitive drum 1 are provided, in order of the rotation direction, a charging device (charging unit) 2, an exposure apparatus (latent image forming unit) 3, a developing apparatus (developing unit) 4, and a primary transfer roller (primary transfer unit) 5. Further, a drum cleaner (cleaning unit) 6 is arranged on a downstream side in a drum rotation direction from the primary transfer roller (primary transfer unit) 5. In addition, a transfer conveyance belt 18 is arranged beneath the intermediate transfer belt 17 acting as an intermediate transfer member, and a fixing apparatus (fixing unit) 16 is arranged on a downstream side in the conveyance direction (in FIG. 1, arrow R18 direction) of a transfer member S.

In the present exemplary embodiment, a drum having a diameter of 30 mm is used for the photosensitive drum 1. The photosensitive drum 1 is formed by coating a photosensitive layer, which is typically formed from an organic photoconductor (OPC) layer, on an outer peripheral surface of an earthed drum made from a conductive material, such as aluminum. This photosensitive layer is formed from an undercoat layer (UCL), a charge carrier generation layer (CGL), and a charge carrier transport layer (CTL). The photosensitive layer is normally an insulating layer which has a property of becoming a conductor when irradiated with light in a specific wavelength. This is because holes in the charge carrier generation layer formed due to the irradiation with the light serve as a carrier for the flow of charge. The charge carrier generation layer is formed from a phthalocyanine compound having a thickness of 0.2 μm. The charge carrier transport layer is formed from polycarbonate having a thickness of about 25 μm in which a hydrazone compound is dispersed.

In the present exemplary embodiment, a charging roller 2 is used as the charging unit. The charging roller 2 is arranged so as to be in contact with a surface of the photosensitive drum 1. The charging roller 2 structure has a conductive metal core in its center, with a conductive elastic layer, a medium resistance conductive layer, and a low resistance conductive layer formed on the periphery of this metal core. The charging roller 2 is axially supported by bearings at either end so that it can freely rotate. The charging roller 2 is arranged in parallel to the axis of rotation of the photosensitive drum 1. The bearings at either end of the charging roller 2 press against the photosensitive drum 1 with an appropriate pressing force caused by an elastic member, such as a spring. The charging roller 2 is driven and rotated by the rotation of the photosensitive drum 1 produced by this pressing force.

In the present exemplary embodiment, a laser scanner which turns laser light ON/OFF based on image information is used as the exposure apparatus 3. The surface of the charged photosensitive drum 1 is scanned with laser light generated by the exposure apparatus 3 via a reflection mirror. Consequently, charge on the laser irradiated portion is removed, so that an electrostatic latent image is formed based on the image information.

Figure 2:
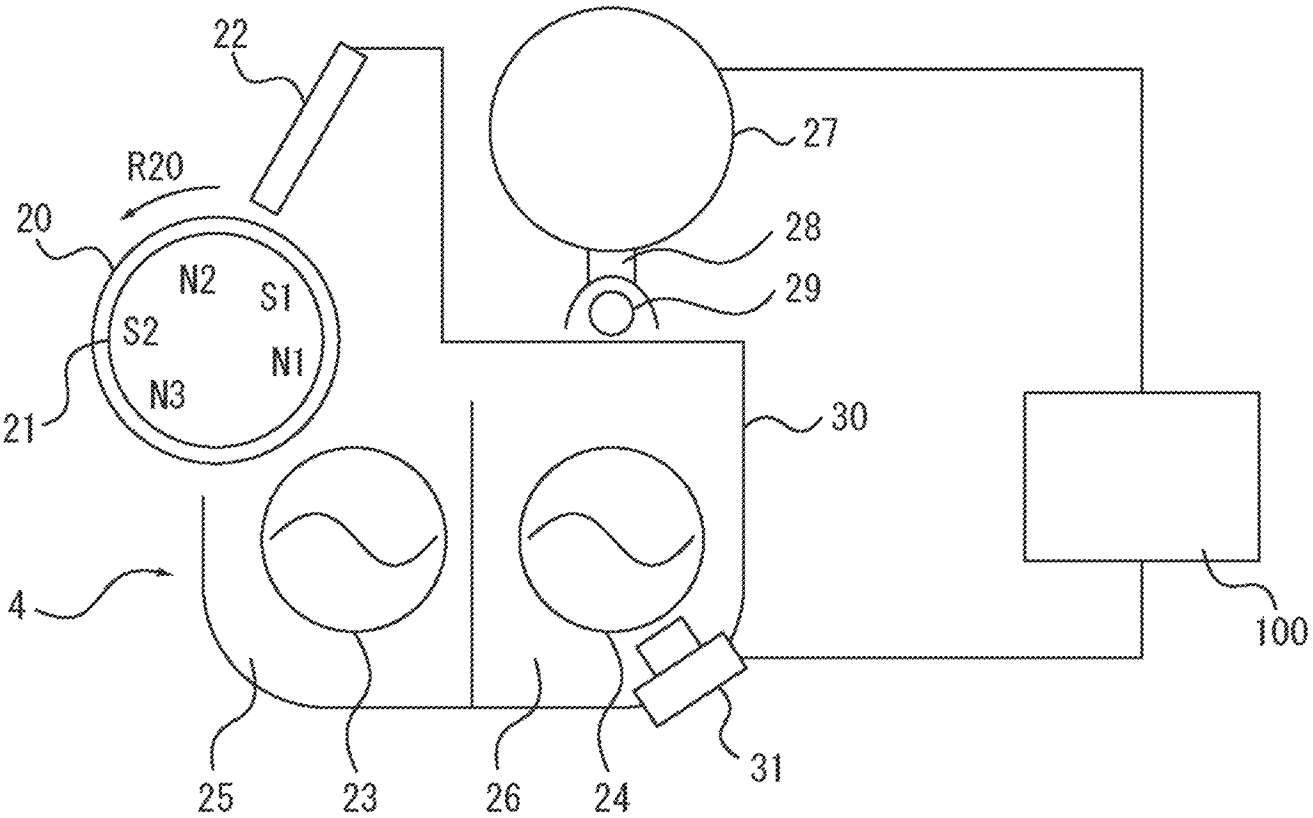
FIG. 2 is a longitudinal sectional view illustrating a configuration of a developing apparatus.

Next, referring to FIG. 2, the developing apparatus 4 for each color will be described. In addition, the details of the developing apparatus will be described below. The developing apparatus 4 includes a development container 30. The development container 30 contains a two-component developer which includes as the developer a toner and a carrier. The development container 30 also includes a development sleeve 20 as a developer carrier unit, an ear cutting member 22 (developer regulating blade) for regulating the brushes of the developer carried on the development sleeve 20. The layer thickness of the developer on the development sleeve 20 is regulated by this regulating blade 22.

In the present exemplary embodiment, an opening is provided at a position corresponding to a development area facing the photosensitive drum 1 of the development container 30. The development sleeve 20 is rotatably arranged in this opening such that a portion of the sleeve 20 is exposed in the photosensitive drum direction. The development sleeve 20 is formed from a non-magnetic material, such as aluminum or stainless steel. The interior of the development sleeve 20 includes a fixed magnet roller 21 which acts as a magnetic field generation unit. During a development operation, the development sleeve 20 rotates in the direction of the arrow R20 (anticlockwise direction) illustrated in FIG. 2. A predetermined amount of the two-component developer is carried to the development area facing the photosensitive drum 1 while the developer regulating blade 22 regulates the layer thickness of the developer on the development sleeve 20. Further, the developer is supplied to the electrostatic latent image formed on the photosensitive drum 1, and the latent image is then developed. The developer carried to the development area by the rotation of the development sleeve 20 is still carried by the development sleeve 20 after development finishes, and is recovered in the development container 30.

On the other hand, an attachable/detachable toner container 27 containing replenishment toner is arranged above the developing apparatus 4. Toner which has been consumed by development is replenished with toner, which passes through a replenishment carrying path 28 from a replenishment port 33 provided in the toner container 27 into the development container 30 from a replenishment port 33 provided in the development container 30. Toner replenishment is performed by predicting the amount of toner which will be consumed by an image based on the video count number of the density of an image obtained by a CCD sensor or the like reading an image information signal, and the toner amount corresponding to the predicted amount is replenished.

In addition, as is described below, a central processing unit (CPU) 100 corrects the toner replenishment amount so that the toner density in the developing unit becomes a target density based on a detection result from a magnetic permeability sensor 31. The magnetic permeability sensor 31 acts as a toner density sensor and is provided in the development container 30.

A replenishment screw (toner replenishment unit) 29 is provided in the replenishment carrying path 28. The toner amount replenished into the development container 30 is adjusted by controlling the rotation time of this replenishment screw 29.

Next, the two-component developer used in the present exemplary embodiment will be described. The two-component developer is formed from a non-magnetic toner and a low-magnetization, high-resistance carrier as main components.

The non-magnetic toner is formed using appropriate amounts of a binder resin such as a styrene resin and a polyester resin, a colorant such as carbon black, a dye, and a pigment, a release agent such as wax, and a charge control agent. The non-magnetic toner may be produced by a method such as crushing, and polymerization.

The non-magnetic toner (negative charging property) has a triboelectric charge amount of preferably about $-1\times10^{-2}$ to $-5.0\times10^{-2}$ C/kg. If the triboelectric charge amount of the non-magnetic toner is not within this range, the counter charge amount generated in the magnetic carrier increases, and the level of white spots deteriorates, so that image defects can be produced. The triboelectric charge amount of the non-magnetic toner may be adjusted based on the types of materials to be used, and may also be adjusted by adding an additive.

The triboelectric charge amount of the nonmagnetic toner can be measured by air-sucking the toner from about 0.5 to 1.5 g of the developer using an ordinary blow-off method, and measuring the charge amount induced in a measurement container.

As the magnetic carrier, a known magnetic carrier may be used. More specifically, examples which may be used include a resin carrier formed by dispersing magnetite as a magnetic material in a resin, and dispersing carbon black in the resultant resin to confer conductivity and to adjust the resistance, and a carrier obtained by subjecting the surface of single magnetite such as ferrite to oxidization and reduction treatments to adjust the resistance. In addition, a carrier obtained by coating the surface of single magnetite such as ferrite with a resin to adjust the resistance may also be used. The method for producing these magnetic carriers is not especially limited to any type.

The magnetic carrier preferably has a magnetization of $3.0\times10^4$ A/m to $2.0\times10^5$ A/m in a 0.1 T magnetic field. If the magnetization level of the magnetic carrier is decreased, as its an effect, scavenging by a magnetic brush can be suppressed. However, adhesion of the carrier onto a non-magnetic cylinder using a magnetic field generation unit becomes more difficult, which can produce image defects such as adhesion of the magnetic carrier onto the photosensitive drum and a swept-together image. Further, if the magnetization of the magnetic carrier is greater than this range, as described above, image defects can be produced due to the pressure of the magnetic brush.

Further, from the perspective of leaks and developability, it is preferred to use a magnetic carrier having a volume resistivity of $10^7$ to $10^{14}$ Ωcm.

The magnetization of the carrier was measured using the oscillating magnetic field type magnetic property automatic recording apparatus BHV-30 manufactured by Riken Denshi Co., Ltd. The magnetic property value of the carrier powder is obtained by producing an external magnetic field of 0.1 T, and determining the intensity of the magnetization at that time. The carrier is packed in a cylindrical plastic container in a sufficiently close state. In this state, the magnetization intensity ($Am^2/kg$) is found by measuring the magnetization moment and the actual weight when the sample is put in. Then, the true specific gravity of the carrier particles is determined using the dry-type automatic density analyzer AccuPyc 1330 (manufactured by Shimadzu Corporation). The magnetization intensity ($Am^2/kg$) is multiplied by the true specific gravity to determine the magnetization intensity ($Am^2/kg$) per unit volume used in the present exemplary embodiment.

In the present exemplary embodiment, an endless intermediate transfer belt 17 is hung as an intermediate transfer member around the primary transfer roller 5 and a secondary transfer roller 11. The intermediate transfer belt 17 is pressed from its underside by the primary transfer roller 5 so that the surface of the intermediate transfer belt 17 abuts the photosensitive drum 1. Consequently, a primary transfer nip (primary transfer portion) is formed between the photosensitive drum 1 and the intermediate transfer belt 17. The intermediate transfer belt 17 is configured so as to rotate in the direction of the arrow R17 along with the rotation in the direction of the arrow R17 of the secondary transfer roller 11, which also acts as a drive roller. The rotation speed of this intermediate transfer belt 17 is set to be approximately the same as the rotation speed of each photosensitive drum 1 (process speed).

In the present exemplary embodiment, a fixing device 16 includes a rotatable fixing roller 14 and a pressure roller 15 which abuts the lower portion of the fixing roller 14. A heater 19, such as a halogen heater, is provided in the interior of the fixing roller 14. The temperature on the surface of the fixing roller 14 is adjusted by controlling the voltage applied to the heater 19.

Next, the operation of an image forming apparatus having the above-described configuration will be described. In FIG. 1, an electrostatic latent image is formed on the photosensitive drum 1 by scanning with light from the exposure apparatus 3 the surface of the photosensitive drum 1 which was uniformly charged by the charging roller 2. The electrostatic latent image formed on the photosensitive drum 1 is developed as a toner image in the respective colors of yellow, magenta, cyan, and black by the developing apparatus 4. These four color toner images are successively transferred onto the intermediate transfer belt 17 by applying a primary transfer bias to the primary transfer roller 5 at the primary transfer nip. Consequently, the four color toner images are superimposed on the intermediate transfer belt 17. During primary transfer, toner remaining on the photosensitive drum 1 (residual toner) which has not been transferred onto the intermediate transfer belt 17 is removed by the drum cleaner 6. The photosensitive drum 1 from which residual toner has been removed is then used to form the next image.

The four color toner image thus superimposed on the intermediate transfer belt 17 is then secondarily transferred onto the transfer material S. The transfer material S conveyed by a paper conveyance apparatus from a paper cassette (not illustrated) is fed to a secondary transfer nip so as to match the timing of the toner image on the intermediate transfer belt 17 with a resist roller. The four color image on the intermediate transfer belt 17 is secondarily transferred onto the fed transfer material S collectively by applying a secondary transfer bias to the secondary transfer roller 11 at the secondary transfer nip.

The transfer material S, on which the secondarily transferred toner images are not yet fixed, is heated and pressed by the fixing roller 14 and the pressure roller of the fixing device 16, whereby the toner image is fixed on the surface. The transfer material S with the thus fixed toner image is then discharged onto a paper discharge tray. Consequently, four color image formation onto one side (surface) of one sheet of the transfer material S is finished. After the secondary transfer, toner remaining on the intermediate transfer belt 17 (transfer residual toner) which has not been transferred is removed by a belt cleaner 10.

Thus, a full color print sequence is finished, and a desired full color print image is formed.

The development bias in the present exemplary embodiment will now be described. In the present exemplary embodiment, a waveform is used in which an alternating current voltage and a direct current voltage are superimposed. One whole cycle is formed from a section A (oscillating portion), in which an alternating current voltage and a direct current voltage are superimposed, and a section B (blank portion), in which only a direct current voltage is applied. The oscillating portion A has a frequency of 15 kHz, and the time required for one period is 100 ms. Since the oscillating portion A is repeated twice, the oscillating portion A is applied for 200 ms. The voltage is applied to blank portion also for 200 ms. The amplitude value of the alternating current voltage (hereinafter, "Vpp") is set at 2.0 kV.

Next, the developing apparatus 4 will be described in further detail. The developing apparatus 4 includes a development container 30. The development container 30 contains a two-component developer which includes as the developer a toner and a carrier. The development container 30 also includes a development sleeve 20 as a developer carrier unit, and an ear cutting member 22 (developer regulating blade) for regulating the brushes of the developer carried on the development sleeve 20.

In the present exemplary embodiment, an opening is provided at a position corresponding to a development area facing the photosensitive drum 1 of the development container 30. The development sleeve 20 is rotatably arranged in this opening so that a portion of the sleeve 20 is exposed in the photosensitive drum direction. The development sleeve 20 is formed from a non-magnetic material, such as aluminum or stainless steel.

The interior of the development sleeve 20 includes a fixed magnet roller 21 which acts as a magnetic field generation unit. The magnet roller 21 has multiple magnetic poles along a circumferential direction. These magnetic poles are divided into a development magnetic pole S2 and carrying magnetic poles N1, N2, S1, and S3. The development magnetic pole S2 produces a magnetic field near a development position where the photosensitive drum 1 and the development sleeve 20 face each other, so that magnetic brushes of the developer is formed on the surface of the development sleeve 20. Consequently, development is performed by the developer on the development sleeve 20 adhering to the electrostatic latent image on the photosensitive drum 1.

On the other hand, the carrying magnetic poles N1, N2, S1, and S3 bear the role of carrying the developer along with the rotation of the development sleeve 20. Among the multiple carrying magnetic poles N1, N2, S1, and S3, the carrying magnetic poles N1 and S3 are arranged adjacent to each other on the development container 30 side. The carrying magnetic poles N1 and S3 have the same pole, and a repelling magnetic field is formed between them. Therefore, developer carried to the carrying magnetic pole S3 while supported on the development sleeve 20 is hindered from moving to the carrying magnetic pole N1 due to the action of this repelling magnetic field. Consequently, the developer falls into the developing apparatus near the carrying magnetic pole S3.

The developer regulating blade 22 is formed from a non-magnetic material, such as aluminum and SUS 16. The developer regulating blade 22 is attached with a predetermined gap formed between it and the surface of the development sleeve 20. This gap regulates the amount of developer carried on the development sleeve 20, more specifically, the layer thickness of the developer on the development sleeve 20.

In the present exemplary embodiment, a development chamber 25 and a stirring chamber 26 partitioned from each other are provided in the interior of the development container 30. Carrying screws 23 and 24 are arranged as developer stirring/carrying units in each of the development chamber 25 and the stirring chamber 26. By driving the stirring/carrying screws 23 and 24 with a driving device, the developer contained in the development container 30 is carried and stirred, so that it circulates in the development container 30. A partition wall which allows communication between the development chamber 25 and the stirring chamber 26 at an end portion of the development container 30 is provided between the stirring/carrying screw 23 and the stirring/carrying screw 24.

Figure 3:
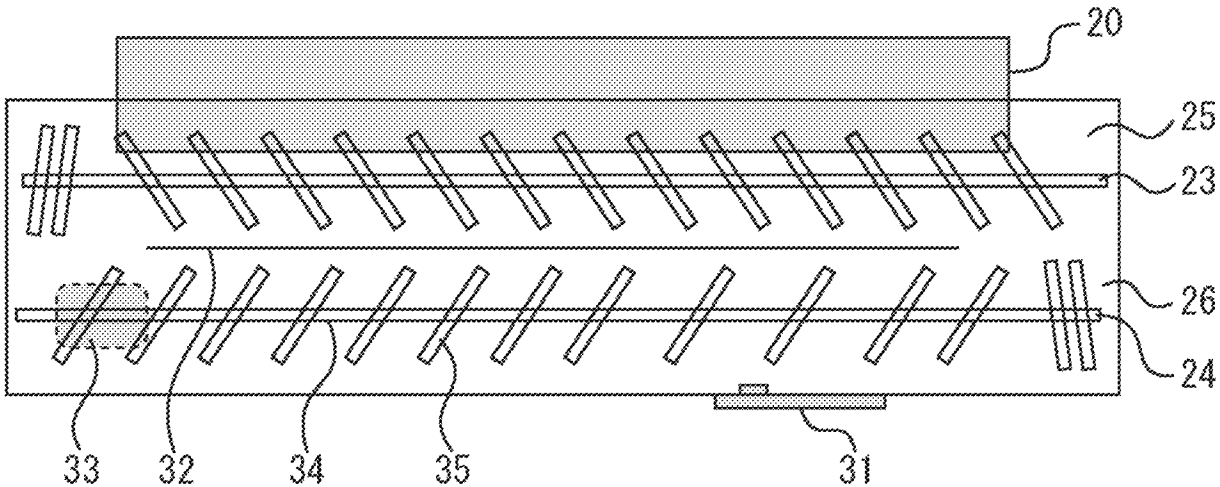
FIG. 3 is a horizontal sectional view illustrating a configuration of a developing apparatus according to a first exemplary embodiment.

FIG. 3 is a diagram of the development container 30 according to the present exemplary embodiment as seen from directly above. As illustrated in FIG. 3, the stirring/carrying screw 23 and the stirring/carrying screw 24 are arranged roughly in parallel, with a partition wall 32 partitioning them from each other so that the developer does not move back and forth between the development chamber 25 and the stirring chamber 26. There is no partition wall at either end portion in the longitudinal direction of the development container 30, so that the developer can move back and forth between the stirring/carrying screw 23 and the stirring/carrying screw 24.

The developer carrying direction of the stirring/carrying screw 23 is opposite from that of the developer carrying direction of the stirring/carrying screw 24, so that a circulation path is formed for circulating the developer in the development container 30 without interruption.

A toner density sensor (magnetic permeability sensor) 31 is provided on a wall face of the development container 30 on the stirring chamber 26 side. In the present exemplary embodiment, an inductance detection type sensor which detects changes in the apparent magnetic permeability of the toner and the carrier is employed as the toner density sensor. The magnetic permeability sensor 31 is provided on a downstream side in the developer carrying direction of the stirring chamber 26. As illustrated in FIG. 2, the magnetic permeability sensor 31 is arranged at an angle on a lower side of the wall face of the development container 30. By mounting the magnetic permeability sensor 31 at an angle on the lower side of the wall face of the development container 30, the demand to reduce the size of the developing apparatus is satisfied.

Figure 4:
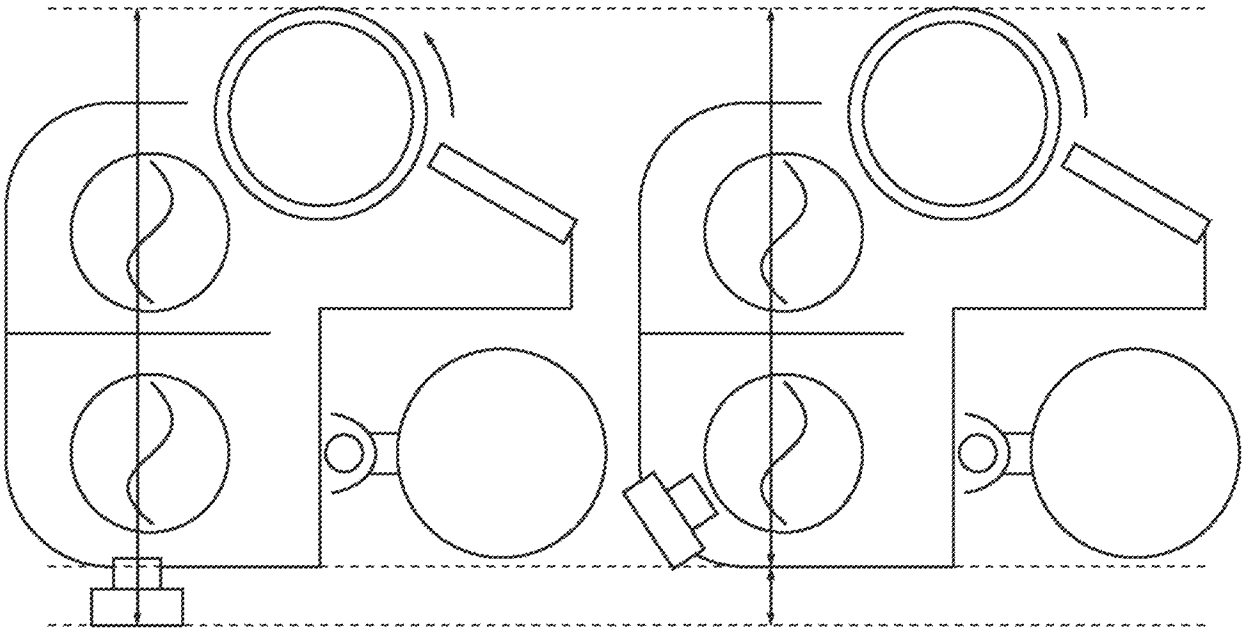
FIG. 4 is a diagram comparing developing apparatus dimensions.

As illustrated in FIG. 4, if cases are compared between when the magnetic permeability sensor 31 is mounted at an angle on the lower side of the wall face of the development container 30, and when the magnetic permeability sensor 31 is mounted perpendicularly in the development container 30, regarding the horizontal direction, the size of the developing apparatus can be reduced only by the thickness of the magnetic permeability sensor 31. In the present exemplary embodiment, while the magnetic permeability sensor 31 is arranged at an angle on the lower side of the wall face of the development container 30, the present invention is not limited to this. The present invention is also effective if the magnetic permeability sensor is arranged perpendicularly on the wall face of the development container, or arranged on a lower face of the development container.

Next, the configuration of the developer stirring/carrying screw 24 near the magnetic permeability sensor 31, which is a characteristic part of the present invention, will be described based on FIG. 3.

The stirring/carrying screw 24 is uniformly provided with screw blades 35, which are stirring blades having a pitch of 25 mm and an outer diameter of 25 mm, in a shaft direction on a rotational shaft 34 having a shaft diameter of 7 mm. A characteristic feature of the present invention is the wide pitch of 35 mm of the stirring/carrying screw 24 in a distance of 25 mm on either side of the magnetic permeability sensor 31. Therefore, a vicinity (first area) which is on an upstream side in the carrying direction from the portion facing the magnetic permeability sensor 31, has a greater developer carrying ability (maximum carrying amount) per unit drive time than an area (second area) which is on an upstream side in the carrying direction of the developer from the first area. Further, a vicinity (third area) which is on a downstream side in the carrying direction of the developer from the portion facing the magnetic permeability sensor 31, has a greater developer carrying ability per unit drive time than the second area. The term "carrying ability" (maximum carrying amount) is defined here as the amount of toner filled in a pitch interval that is carried when the pitch intervals of the stirring/carrying screw 24 are filled with toner. The larger this value, the higher the developer carrying amount (greater the carrying ability, which means a faster carrying rate of the developer at that position.

Thus, the average carrying rate of the developer at the portion facing the magnetic permeability sensor 31 is faster than the carrying rate at other portions.

Therefore, the developer facing the magnetic permeability sensor face receives a stronger carrying force in the shaft direction of the stirring/carrying screw 24. Consequently, in the present exemplary embodiment, the height of the developer surface of the sensor facing portion when the stirring/carrying screw 24 is driven is lower than the average developer surface height of the circulation path. The developer carrying rate in the circulation direction in the circulation path is defined as the average value of the carrying rates of the developer passing through a cross-section orthogonal to the circulation direction of the circulation path.

The maximum carrying amount of the stirring/carrying screw 24 at the portion facing the magnetic permeability sensor 31 is preferably 1.1 to 7 times the average value of the maximum carrying amount of the stirring/carrying screw 24. If the carrying rate at the portion facing the magnetic permeability sensor 31 is less than 1.1 times the average value, the effect of suppressing developer retention becomes difficult to obtain. Further, if the carrying rate at the portion facing the magnetic permeability sensor 31 is more than 7 times compared with the average value, the developer surface at the sensor facing portion dramatically deteriorates, and detection accuracy deteriorates.

The developer carrying rate can be easily measured by measuring the surface height of the developer when the developer is carried as follows. This is because the surface height of the developer decreases as the developer carrying rate becomes faster. In the present exemplary embodiment, the developer carrying rate was obtained by flattening the developer surface in the developing apparatus in advance, measuring the surface height of the developer three times when a carrying member in the developing apparatus is driven for several tens of seconds at the same speed as during image formation, and taking the inverse of the average of the three measured values as the developer carrying rate.

Further, in a case of longitudinal stirring, in which the development chamber and the stirring chamber are aligned in the direction of gravity, more developer can pile in one of these chambers. In such a case, measurement is performed after the stirring member has been driven until the distribution amounts in the development chamber and the stirring chamber 26 are in equilibrium. In such a case, since the developer cannot deposit in an exchange portion between the development chamber and the stirring chamber, for the circulation path, the average value of the developer surface deposited on the bottom of the development chamber and the stirring chamber excluding the exchange portion is used as the circulation path developer height average value.

As a more accurate method for measuring the developer carrying rate, differently colored toners may be put into the developing apparatus, the carrying member is driven. Then, the movement speed of the differently colored developers at that time may be directly measured using a high-speed camera.

In the present exemplary embodiment, the area in which the pitch interval of the stirring/carrying screw 24 is widened, is 50 mm, more specifically, in a distance of 25 mm on either side of the sensor. From the perspective of the present invention, 50 mm is sufficient. Although it is not necessary to lengthen this area too much, the same effects can still be obtained even if this area is lengthened. However, if this area is lengthened too much, the stirring properties of the developer in that area deteriorate, which can cause problems in terms of stirring (it is difficult to mix the replenishment toner with the developer and difficult to make the toner density uniform).

On the other hand, if the area in which the pitch of the stirring/carrying screw 24 blades is widened is too short, although an improvement is obtained, the effect may not be sufficient. Therefore, this area may be set based on the outer diameter of the stirring/carrying screw and the like in a preferable range of 30 to 70 mm, and more preferably 40 to 60 mm. In addition, although in the present exemplary embodiment the area in which the blade pitch of the stirring/carrying screw 24 is widened is 25 mm on either side of the sensor, the interval in which the pitch is widened does not have to be uniform on either side of the sensor.

Next, a second exemplary embodiment according to the present invention will be described. The basic configuration and operations of the image forming apparatus according to the present exemplary embodiment are the same as in the first exemplary embodiment.

Figure 5A:
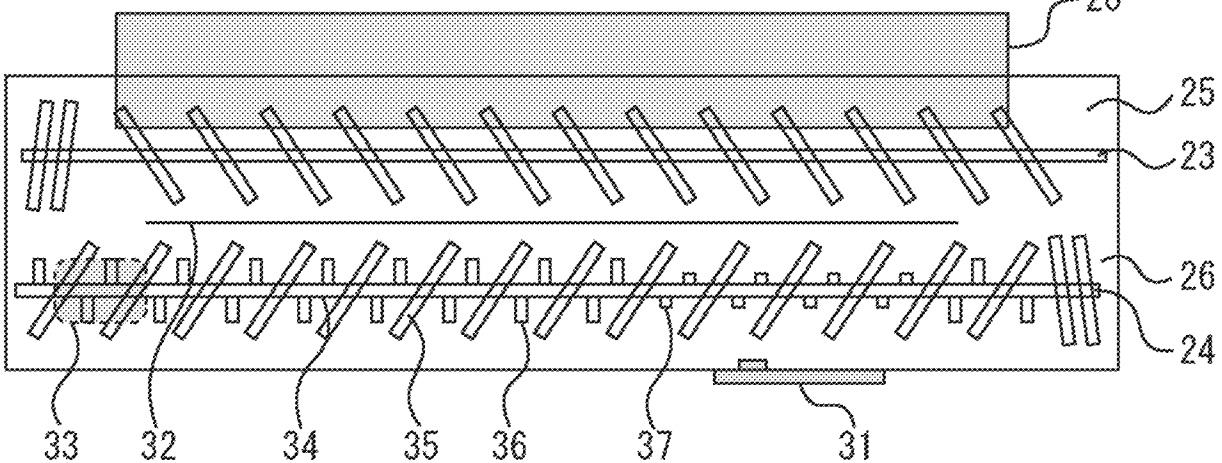
FIGS. 5A and 5B are horizontal sectional views illustrating a configuration of a developing apparatus according to a second exemplary embodiment.

FIG. 5A illustrates a configuration of a developing apparatus according to the present exemplary embodiment. The stirring/carrying screw 24 is uniformly provided with screw blades 35, which are stirring blades having a pitch of 30 mm and an outer diameter of 25 mm, in a shaft direction on a rotational shaft 34 having a shaft diameter of 7 mm. Further, ribs 36 are provided on the shaft of the stirring/carrying screw 24. The ribs are 5 mm wide, 7 mm high, and 1 mm thick, and are spaced on the shaft at 180° intervals.

A characteristic feature of the present invention is that the dimensions of ribs 37 provided on the stirring/carrying screw 24 over 3 pitch intervals facing the magnetic permeability sensor 31 are a width of 5 mm, a height of 3 mm, and a thickness of 1 mm. In other words, the width and the thickness are the same as in the other portions while the height is lower, namely 3 mm. More specifically, the volume of the ribs per unit length in the area facing the magnetic permeability sensor 31 is less than that in other areas. Therefore, the carrying rate of the developer near the magnetic permeability sensor 31 is faster than the carrying rate at other portions. Consequently, the developer facing the magnetic permeability sensor face receives a stronger carrying force in the shaft direction of the stirring/carrying screw 24.

In the present exemplary embodiment, the range in which the height of the ribs 37 provided on the shaft of the stirring/carrying screw 24 is changed is 3 pitch intervals. From the perspective of the present invention, a range of 3 pitch intervals is sufficient. Although it is not necessary to increase much more than this, the same effects can still be obtained even if this range is increased. However, if this range is increased too much, the stirring properties of the developer in that range deteriorate, which can cause problems in terms of stirring. On the other hand, if the range in which the height of the ribs 37 provided on the shaft of the stirring/carrying screw 24 is changed is too short, although an improvement is obtained, the effect may not be sufficient. Therefore, a preferred range may be set based on the outer diameter of the stirring/carrying screw and the like in a range which combines both stirring properties and carrying properties.

Further, in the present exemplary embodiment, although an effect is obtained by changing the height of the ribs 37 provided on the shaft of the stirring/carrying screw 24, the same effect can also be obtained by making the rib width narrower than the surrounding area or making the rib thickness thinner than the surrounding area.

Figure 5B:
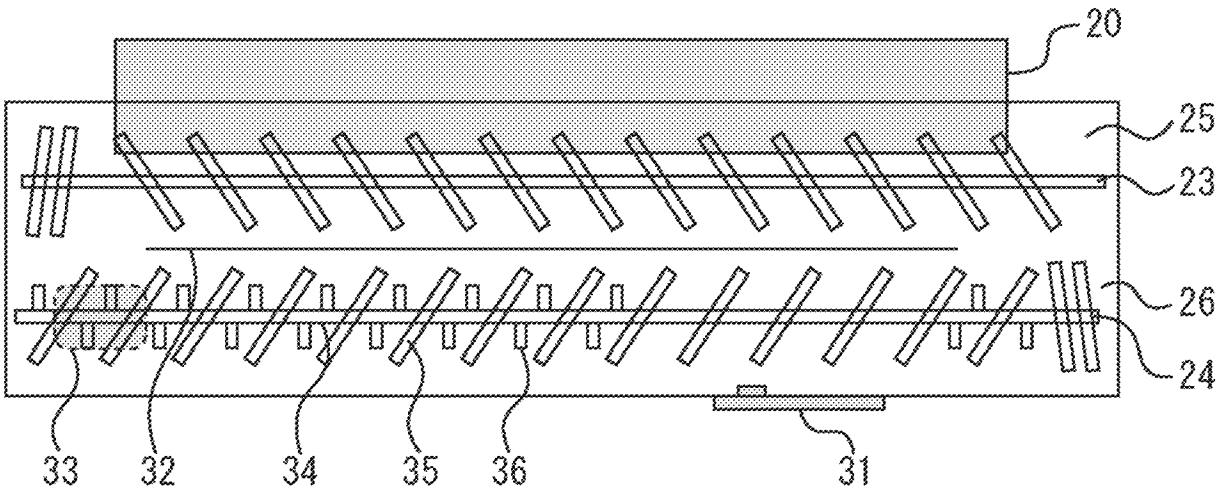

In addition, in the present exemplary embodiment, an effect is obtained by changing the dimensions of the ribs 37 provided on the shaft of the stirring/carrying screw 24. However, as illustrated in FIG. 5B, the same effect can also be obtained by not providing ribs on the shaft of the stirring/carrying screw 24 near the magnetic permeability sensor 31.

The basic configuration and operations of the image forming apparatus according to a third exemplary embodiment are the same as in the first exemplary embodiment.

Figure 6:
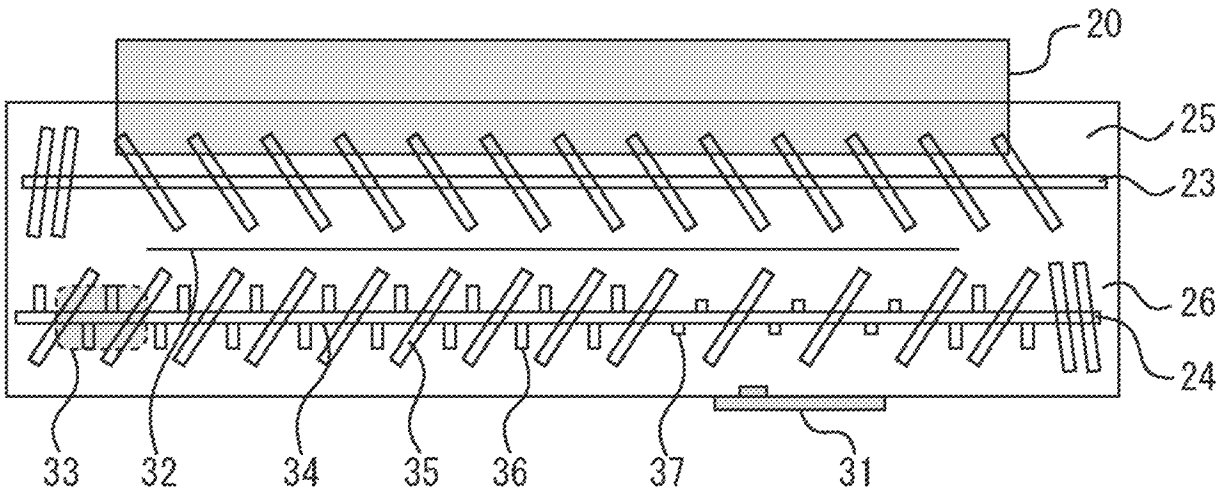
FIG. 6 is a horizontal sectional view illustrating a configuration of a developing apparatus according to a third exemplary embodiment.

The present exemplary embodiment has a configuration which combines the first and second exemplary embodiments. FIG. 6 illustrates a configuration of a developing apparatus according to the present exemplary embodiment. The stirring/carrying screw 24 is uniformly provided with screw blades 35, which are stirring blades having a pitch of 30 mm and an outer diameter of 25 mm, in a shaft direction on a rotational shaft 34 having a shaft diameter of 7 mm. Further, ribs 36 are provided on the shaft of the stirring/carrying screw 24. The ribs are 5 mm wide, 7 mm high, and 1 mm thick, and are spaced on the shaft at 180° intervals. A characteristic feature of the present invention is the wide pitch of 35 mm of the stirring/carrying screw 24 in a distance of 25 mm on either side of the magnetic permeability sensor 31. Another characteristic feature of the present invention is that the dimensions of the ribs 37 provided on the stirring/carrying screw 24 in the 35 mm pitch interval are a width of 5 mm, a height of 5 mm, and a thickness of 1 mm. Based on the above-described two effects, the carrying rate of the developer near the magnetic permeability sensor 31 is faster than the carrying rate at other portions. Consequently, the developer facing the magnetic permeability sensor face receives a stronger carrying force in the shaft direction of the stirring/carrying screw 24.

The basic configuration and operations of the image forming apparatus according to a fourth exemplary embodiment are the same as in the first exemplary embodiment.

Figure 7:
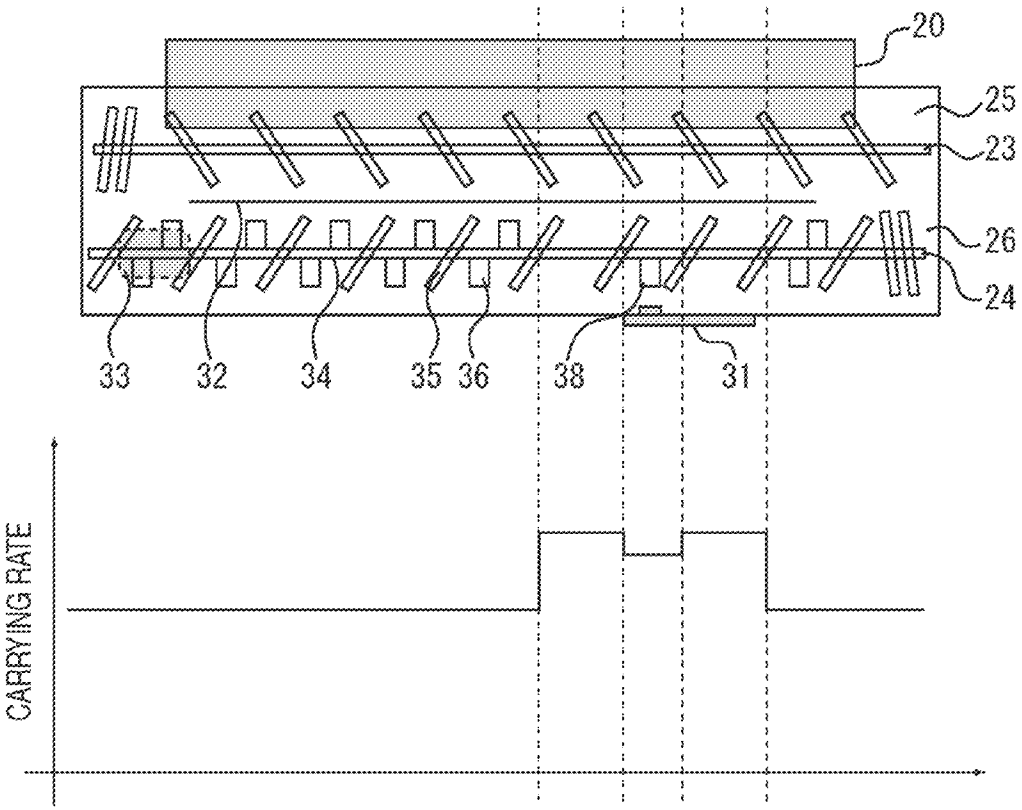
FIG. 7 is a horizontal sectional view schematically illustrating a configuration of a developing apparatus according to a fourth exemplary embodiment, and the carrying rate of a developer.

FIG. 7 illustrates a configuration of a developing apparatus according to the present exemplary embodiment. The stirring/carrying screw 24 is uniformly provided with screw blades 35, which are stirring blades having a pitch of 25 mm and an outer diameter of 25 mm in a shaft direction on a rotational shaft 34 having a shaft diameter of 7 mm. Further, ribs 36 are provided on the shaft of the stirring/carrying screw 24. The ribs are 5 mm wide, 7 mm high, and 1 mm thick, and are spaced on the shaft at 180° intervals. A characteristic feature of the present invention is the provision of one rib on the shaft of the stirring/carrying screw 24 facing the magnetic permeability sensor 31, and not providing ribs on the shaft of the stirring/carrying screw 24 in a 1 pitch interval either side of that rib. Consequently, in addition to the effects of promoting the replacement of the developer at the portion facing the sensor face, and retention prevention, since the carrying rate of the developer near the magnetic permeability sensor 31 increases, the developer facing the magnetic permeability sensor face receives a stronger carrying force in the shaft direction of the stirring/carrying screw 24.

FIG. 7 schematically illustrates the carrying rate in a longitudinal direction in the stirring chamber 26 according to the present exemplary embodiment. The carrying rate near the magnetic permeability sensor 31 is faster than the carrying rate of the surrounding area. Further, although the carrying rate at the portion facing the magnetic permeability sensor 31 is slower than the carrying rate near the magnetic permeability sensor 31, it is faster than the carrying rate of the surrounding area. Consequently, the developer facing the magnetic permeability sensor face receives a stronger carrying force in the shaft direction of the stirring/carrying screw 24.

In addition, the stirring properties of the sensor facing portion can be improved by making the volume of the rib provided on the portion facing the magnetic permeability sensor 31 larger than the ribs provided further upstream from that rib. Moreover, the rib provided on the portion facing the magnetic permeability sensor 31 may be larger than the sensor detection face and larger than the width in the rotational shaft direction of the carrying screw.

In this case, although the carrying ability in the direction of the rotational axis of the carrying screw 24 at the sensor facing portion decreases, the carrying ability in the direction of the rotational axis of the carrying screw 24 on a just upstream side in the sensor facing portion increases. Therefore, developer retention can be sufficiently suppressed. More specifically, as illustrated in FIG. 7, the stirring properties at the sensor facing portion can be improved while also maintaining the developer carrying rate (developer carrying amount) in the direction of the rotational axis of the stirring/carrying screw 24 at the sensor facing portion at a high level.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-094102 filed Apr. 8, 2009, which is hereby incorporated by reference herein in its entirety.

What is claimed is:

1. A developing apparatus comprising:

a developer container configured to contain a developer including a non-magnetic toner and a magnetic carrier, the developer container including a first chamber configured to contain the developer, a second chamber communicating with the first chamber at both ends of the first chamber to form a circulation path, and a partition wall between the first and second chambers;

a developer carrier configured to carry the developer contained in the developer container and convey the developer to a development area opposed to an image carrier, a density sensor configured to detect information on a permeability of the developer in the developer container; and a carrying member, including a rotational shaft provided at a position opposed to the density sensor and a spiral screw formed around the rotational shaft, configured to carry the developer in the developer container, wherein the carrying member includes a first upstream area adjacent to a position opposed to a detection surface of the density sensor on an upstream side in a developer carrying direction and a second upstream area adjacent to the first upstream area on the upstream side in the developer carrying direction, and wherein a stirring force in a rotational direction of the carrying member per unit pitch interval of the screw of the carrying member is smaller in the first upstream area than in the second upstream area so that the carrying member has a higher carrying ability per unit pitch interval in a direction of the rotational shaft in the first upstream area than in the second upstream area.

2. The developing apparatus according to claim 1, wherein the carrying member includes a first downstream area adjacent to the position opposed to the detection surface of the density sensor on a downstream side in the developer carrying direction, and the stirring force in the rotational direction of the carrying member per unit pitch interval is smaller in the first downstream area than in the second upstream area so that the carrying member has a higher carrying ability per unit pitch interval in the direction of the rotational shaft in the first downstream area than in the second upstream area.

3. The developing apparatus according to claim 2, wherein the carrying member includes a second downstream area adjacent to the first downstream area on a downstream side, and the stirring force of the carrying member in the rotational direction of the carrying member per unit pitch interval is lower in the first upstream area and the first downstream area than in the second downstream area so that the carrying member has a higher carrying ability in the direction of the rotational shaft of the carrying member per unit pitch interval in the first upstream area and the first downstream area than in the second downstream area.

4. The developing apparatus according to claim 2, wherein stirring force of the carrying member in the rotational direction of the carrying member per unit pitch interval is higher in the area opposed to the density sensor than in the first upstream area.

5. The developing apparatus according to claim 2, wherein the carrying member has a higher carrying ability per unit pitch interval in the direction of the rotational shaft of the carrying member in the first downstream area and the first upstream area than in other areas.

6. The developing apparatus according to claim 1, wherein a pitch interval of the screw provided in the first upstream area is wider than a pitch interval of the screw provided in the second upstream area.

7. The developing apparatus according to claim 1, wherein the carrying member is provided with a rib configured to stir a developer, and a volume of the rib per unit pitch interval is smaller in the first upstream area of the carrying member than in the second upstream area, or there is no rib in the first upstream area so that the stirring force of the carrying member in the rotational direction of the carrying member per unit pitch interval is lower in the first upstream area than in the second upstream area.

8. The developing apparatus according to claim 1, wherein the first upstream area is adjacent to a one-pitch area opposed to the detection surface of the density sensor on an upstream side.

9. The developing apparatus according to claim 2, wherein the first downstream area is adjacent to a one-pitch area opposed to the detection surface of the density sensor on a downstream side.

10. The developing apparatus according to claim 2, wherein a distance from an upstream end of the first upstream area to a downstream end of the first downstream area in the direction of the rotational shaft of the carrying member is 30 to 70 mm.

11. The developing apparatus according to claim 1, wherein the density sensor is disposed at a position below a horizontal position in a gravitational direction and above a lowest position in the gravitational direction in the rotational direction of the carrying member in such a way that the density sensor projects from an inner wall of the developer container toward the carrying member.

12. The developing apparatus according to claim 1, wherein the density sensor is disposed on a downstream side of a stirring chamber in a carrying direction.

13. The developing apparatus according to claim 1, wherein an outer diameter of the carrying member in the first upstream area is substantially same as an outer diameter of the carrying member in the second upstream area.

14. A developing apparatus comprising:

a developer container configured to contain a developer including a non-magnetic toner and a magnetic carrier, the developer container including a first chamber configured to contain the developer, a second chamber communicating with the first chamber at both ends of the first chamber to form a circulation path, and a partition wall between the first and second chambers;

a developer carrier configured to carry the developer contained in the developer container and convey the developer to a development area opposed to an image carrier, a density sensor configured to detect information on a permeability of the developer in the developer container; and a carrying member, including a rotational shaft provided at a position opposed to the density sensor and a spiral screw formed around the rotational shaft, configured to carry the developer in the developer container, wherein the carrying member includes a first downstream area adjacent to a position opposed to a detection surface of the density sensor on a downstream side in a developer carrying direction and a second downstream area adjacent to the first downstream area on the downstream side in the developer carrying direction, and wherein a stirring force in a rotational direction of the carrying member per unit pitch interval of the screw of the carrying member is smaller in the first downstream area than in the second downstream area so that the carrying member has a higher carrying ability per unit pitch interval in a direction of the rotational shaft in the first downstream area than in the second downstream area.

15. The developing apparatus according to claim 14, wherein the carrying member includes a first upstream area adjacent to the position opposed to the detection surface of the density sensor on an upstream side in the developer carrying direction, and the stirring force in the rotational direction of the carrying member per unit pitch interval is smaller in the first upstream area than in the second downstream area so that the carrying member has a higher carrying ability per unit pitch interval in the direction of the rotational shaft in the first upstream area than in the second downstream area.

16. The developing apparatus according to claim 15, wherein the first upstream area is adjacent to a one-pitch area opposed to the detection surface of the density sensor on a upstream side.

17. The developing apparatus according to claim 15, wherein a distance from an upstream end of the first upstream area to a downstream end of the first downstream area in the direction of the rotational shaft of the carrying member is 30 to 70 mm.

18. The developing apparatus according to claim 15, wherein the carrying member includes a second upstream area adjacent to the first upstream area on an upstream side, and wherein the stirring force of the carrying member in the rotational direction of the carrying member per unit pitch interval is lower in the first upstream area and the first downstream area than in the second upstream area so that the carrying member has a higher carrying ability in the direction of the rotational shaft of the carrying member per unit pitch interval in the first upstream area and the first downstream area than in the second upstream area.

19. The developing apparatus according to claim 14, wherein stirring force of the carrying member in the rotational direction of the carrying member per unit pitch interval is higher in the area opposed to the density sensor than the first downstream area.

20. The developing apparatus according to claim 15, wherein the carrying member has a higher carrying ability per unit pitch interval in the direction of the rotational shaft of the carrying member in the first downstream area and the first upstream area than in other areas.

21. The developing apparatus according to claim 14, wherein a pitch interval of the screw provided in the first downstream area is wider than a pitch interval of the screw provided in the second downstream area.

22. The developing apparatus according to claim 14, wherein the carrying member is provided with a rib configured to stir a developer, and a volume of the rib per unit pitch interval of the screw of the carrying member is smaller in the first downstream area of the carrying member than in the second downstream area, or there is no rib in the first downstream area so that the stirring force of the carrying member in the rotational direction of the carrying member per unit pitch interval is lower in the first upstream area than in the second upstream area.

23. The developing apparatus according to claim 14, wherein the first downstream area is adjacent to a one-pitch area opposed to the detection surface of the density sensor on a downstream side.

24. The developing apparatus according to claim 14, wherein the density sensor is disposed at a position below a horizontal position in a gravitational direction and above a lowest position in the gravitational direction in the rotational direction of the carrying member in such a way that the density sensor projects from an inner wall of the developer container toward the carrying member.

25. The developing apparatus according to claim 14, wherein an outer diameter of the carrying member in the first downstream area is substantially same as an outer diameter of the carrying member in the second downstream area.

* * * * *